US006591536B2

(12) United States Patent
Houde-Walter et al.

(10) Patent No.: US 6,591,536 B2
(45) Date of Patent: Jul. 15, 2003

(54) METHOD AND APPARATUS FOR SIDE OF FRAME POSITIONING OF LASER SIGHTS AND LED ILLUMINATORS

(75) Inventors: William R. Houde-Walter, Rush, NY (US); Stephen D. Gerhardt, Conesus, NY (US)

(73) Assignee: LaserMax Inc., Rochester, NY (US)

( * ) Notice: Subject to any disclaimer, the term of this patent is extended or adjusted under 35 U.S.C. 154(b) by 0 days.

(21) Appl. No.: 10/162,316

(22) Filed: Jun. 4, 2002

(65) Prior Publication Data

US 2002/0194767 A1 Dec. 26, 2002

Related U.S. Application Data

(60) Provisional application No. 60/296,671, filed on Jun. 7, 2001.

(51) Int. Cl.[7] ..... F41G 1/34

(52) U.S. Cl. ..... 42/114; 42/115; 42/117; 42/146

(58) Field of Search ..... 42/114, 115, 146, 42/117, 124, 125, 126

(56) References Cited

U.S. PATENT DOCUMENTS

| | | | | | |
|---|---|---|---|---|---|
| 4,878,307 | A | * | 11/1989 | Singletary | 42/124 |
| 4,934,086 | A | | 6/1990 | Houde-Walter | 42/103 |
| 5,042,186 | A | * | 8/1991 | Bechtel | 362/110 |
| 5,056,254 | A | * | 10/1991 | Bechtel | 362/110 |
| 5,107,612 | A | * | 4/1992 | Bechtel | 42/115 |
| 5,179,235 | A | | 1/1993 | Toole | 42/103 |
| 5,299,375 | A | * | 4/1994 | Thummel et al. | 362/110 |
| 5,323,555 | A | * | 6/1994 | Jehn | 42/115 |
| 5,435,091 | A | * | 7/1995 | Toole et al. | 362/114 |
| 5,495,675 | A | * | 3/1996 | Huang | 124/87 |
| 5,509,226 | A | | 4/1996 | Houde-Walter | 42/103 |
| 5,584,137 | A | * | 12/1996 | Teetzel | 362/114 |
| 5,617,444 | A | | 4/1997 | Houde-Walter | 372/77 |
| 5,694,713 | A | * | 12/1997 | Paldino | 33/DIG. 21 |
| 5,706,600 | A | | 1/1998 | Toole et al. | 42/103 |
| 5,761,235 | A | | 6/1998 | Houde-Walter | 42/103 |
| 5,784,823 | A | * | 7/1998 | Chen | 362/110 |

* cited by examiner

*Primary Examiner*—Charles T. Jordan
*Assistant Examiner*—John W. Zerr
(74) *Attorney, Agent, or Firm*—Eugene Stephens & Associates; Steven R. Scott

(57) ABSTRACT

This laser-sighting system can be constructed as a compact side module for use with a revolver or automatic pistol. Features on the side of the firearm such as the yoke screw and the other side plate screws of a revolver are used to secure this laser-sighting system in a favorable location on the side of the firearm frame above the trigger guard forward of the grip, but behind the leading edge of the firearm's trigger guard. The takedown pins or slide stops found in this same location on many automatic pistols can also be used for this purpose. The system uses a very thin self-contained laser-sighting module that does not interfere with the holstering, concealment, or handling of the firearm. The system can also contain a white light or colored LED for illumination and communication.

55 Claims, 6 Drawing Sheets

METHOD AND APPARATUS FOR SIDE OF FRAME POSITIONING OF LASER SIGHTS AND LED ILLUMINATORS

This application claims the benefit of U.S. Provisional Application No. 60/296,671, filed on Jun. 7, 2001, which provisional application is incorporated by reference herein.

FIELD OF THE INVENTION

This invention pertains generally to the field of laser sights for attachment to firearms.

BACKGROUND OF THE INVENTION

Laser sights for firearms have proven themselves to be extremely useful in expediting and improving accurate aim and firing. They have also been found to be useful to police in reducing violence, as the red dot projected on a suspect is very intimidating and often leads to the suspect's immediate surrender. Thus, laser-sighting systems have achieved widespread acceptance in law enforcement and increasing popularity with the general public.

Laser-sighting systems can be mounted to firearms in a variety of ways. Some seek to clamp the system to the exterior of the automatic pistol or revolver. A typical system of this type is taught in U.S. Pat. No. 5,179,235, which describes a system where a laser-sighting device is clamped to the front of the trigger guard for an automatic pistol or revolver. Unfortunately, laser-sighting systems mounted in such locations tend to be bulky and to hamper the ease of holstering, carrying, and using the firearm. One solution to this problem—internal mounting—can be used with an automatic pistol (see, U.S. Pat. No. 5,509,226). However, revolvers lack an accessible internal structure to facilitate laser mounting.

Another solution is attempted in the system described in U.S. Pat. No. 5,435,091. In this system, a laser is positioned above the handgrip at the butt end of the firearm with circuitry positioned in a handgrip plate. This laser-sighting system uses existing features to make the device unobtrusive and functional. However, it lacks utility when the typical method of holding and firing firearms in the law enforcement context is considered.

Law enforcement personnel are trained to keep their fingers off of the trigger until it is necessary to fire their weapon. The usual place for positioning the finger is along the side of the pistol directly above the trigger guard. (This position is particularly favored as it allows law enforcement personnel to evaluate a threatening situation with minimum danger of accidentally discharging the weapon, while keeping the trigger finger poised close to the trigger.) The laser-sighting system illustrated in U.S. Pat. No. 5,435,091 is positioned on the left side of the pistol with an activating switch mid-way down the grip on that side. This type of positioning would be suitable for users holding the weapon in their right hand. In this position, a trigger finger held above the trigger guard would not block the laser beam projected by the sight. In addition, the second finger of the right hand can be used to press the activation switch. However, the design fails on two counts with a left-handed user. First, and most importantly, the positioning of the user's trigger finger above the trigger guard prior to firing blocks the laser sight. Second, the user's palm overlies the activating switch, either activating it prematurely or blocking it from activation. Thus, this particular system must be customized for right- or left-handed users and presents obvious difficulties when used by the other.

Another problem arises from the fact that a two-handed grip is almost universal in law enforcement firearm training and use. Depending on the user, this may involve placement of the hand not gripping the firearm (the "outside" hand) directly under the pistol grip or partially over and in front of the "inside" hand holding the firearm. In the latter situation, the user may once again prematurely activate the laser sight due to hand/palm pressure from the outside hand on the finger of the inside hand covering the activation switch.

Thus, there remains a need for the development of a laser-sighting system that can be used with both revolvers and automatic pistols and that will be compact, unobtrusive, and easy to operate. Further, it should not interfere with the holstering and use of the firearm. Finally, and most importantly for the purposes of this invention, it must be particularly suited for use in the law enforcement context. Thus, it should take into account, and even take advantage of, the pre-firing positioning of the trigger finger above the trigger guard. Further, an improved laser-sighting system should accommodate the needs of both right- and left-handed users and also be suited for use with a two-handed grip.

SUMMARY AND OBJECTS OF THE INVENTION

The laser-sighting system we have invented positions the laser diode and, preferably, its activating switch directly above the trigger guard along the side of the pistol. Many modern revolvers, such as those produced by Smith and Wesson, Taurus, and other manufacturers, have side plates secured by side plate screws including yoke screws. Our laser-sighting system is constructed as a compact side module that can be fastened via side plate screws including the yoke screw of such a revolver. Other side plate screws can also be used to secure this laser-sighting system in the location specified on the side of the revolver frame forward of the grip, above the trigger guard, but behind the trigger guard's leading edge.

We have found that this is an extremely advantageous location for mounting. First, it allows activation of our invention by the tip of the trigger finger when resting on the side of the revolver frame above the trigger. Second, it does not create the difficulties previously discussed where switches are located on the side of the handgun's handle. With our invention, the two-handed user can easily activate the switch when the laser module is located over his trigger finger. Conversely, he can also easily activate the switch when it is on the opposite side of the handgun by using the index finger or thumb of his outside hand. Third, locating a laser module in this position does not interfere with holstering, unlike laser modules positioned farther forward on a handgun. Fourth, location of the laser module in this position avoids interference with the laser beam when the trigger finger is placed above the trigger guard.

In addition, we have discovered that our invention can be adapted for use with automatic pistols. Many modern automatic pistols have takedown pins or slide stops forward of the grip and above the trigger guard instead of yoke screws. We have discovered that these pins can be used to help secure our laser-sighting system in a favorable location for mounting above the trigger guard that, once again, provides the advantages discussed above.

Finally, we have discovered that, for both automatic pistols and revolvers, an extension can also be used to secure (in whole or in part) the side-mounted/side-activated laser system of our invention. The extension is held in place under a grip panel by the panel and the screws that fasten it to the grip of the handgun. The extension, like the other parts of our invention, is very thin. (In fact, in our preferred embodiment, the laser-sighting module is 0.25" or less in thickness.) Thus, it does not interfere with the holstering, concealment, or handling of the firearm.

Our laser system is preferably self-contained, including a laser diode and lens, a white light LED, a diode laser control circuit, a battery, and an activation switch. Alignment and sighting of the laser in our invention is preferably accomplished by controlled positioning of the collimating lens in relation to the laser diode. Other techniques for laser alignment could involve pivoting the side-mounted laser sight about the yoke screw or through a flexure mechanism, such as one theft deforms the shape of a polymer or flexible laser mount in a controlled fashion. On the side of our laser-sighting system abutting the firearm, the laser mount is contoured to match the shape of the firearm frame.

DETAILED DESCRIPTION

Figure 1:
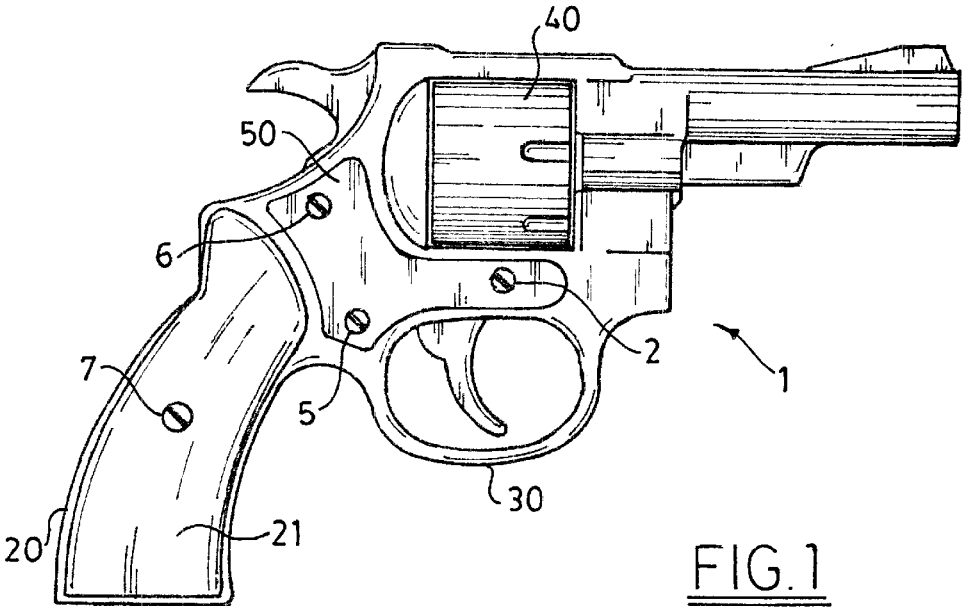
FIG. 1 PRIOR ART
FIG. 1 provides a side view of a typical revolver frame, detailing the location of the yoke screw and the side plate that protects the inner workings of the revolver.
Figure 4:
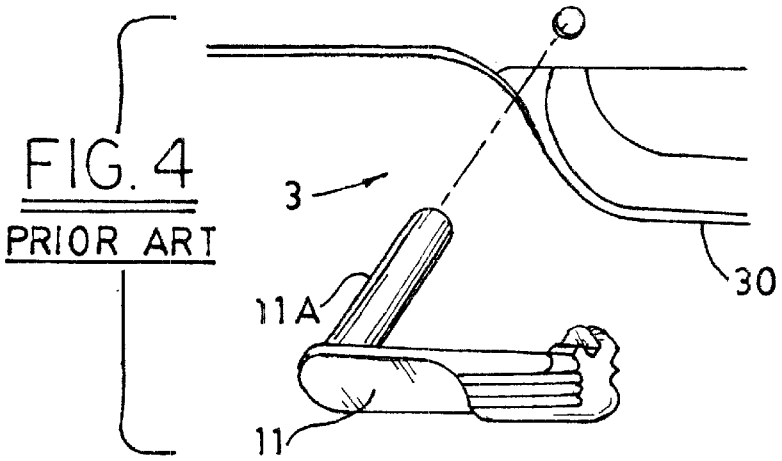
FIG. 4 PRIOR ART
FIG. 4 provides an exploded left side view of a portion of a typical auto-loading pistol frame, detailing the location of the slide stop/takedown lever.

FIGS. 1 and 4 provide structural details for typical revolvers and automatic pistols as a necessary precursor to a discussion of how our invention is intended to work. FIG. 1 provides a side view of a revolver frame (denoted generally by arrow 1), with handle 20 covered by grips 21, trigger guard 30, and cartridge chamber 40. Yoke screw 2, at least one other lower screw 5, and sometimes an upper screw 6 hold revolver side plate 50 in position. FIG. 4 likewise shows an automatic pistol (denoted generally by arrow 3) with a typical threaded slide stop/takedown lever 11 on its side 13.

Figure 2A:
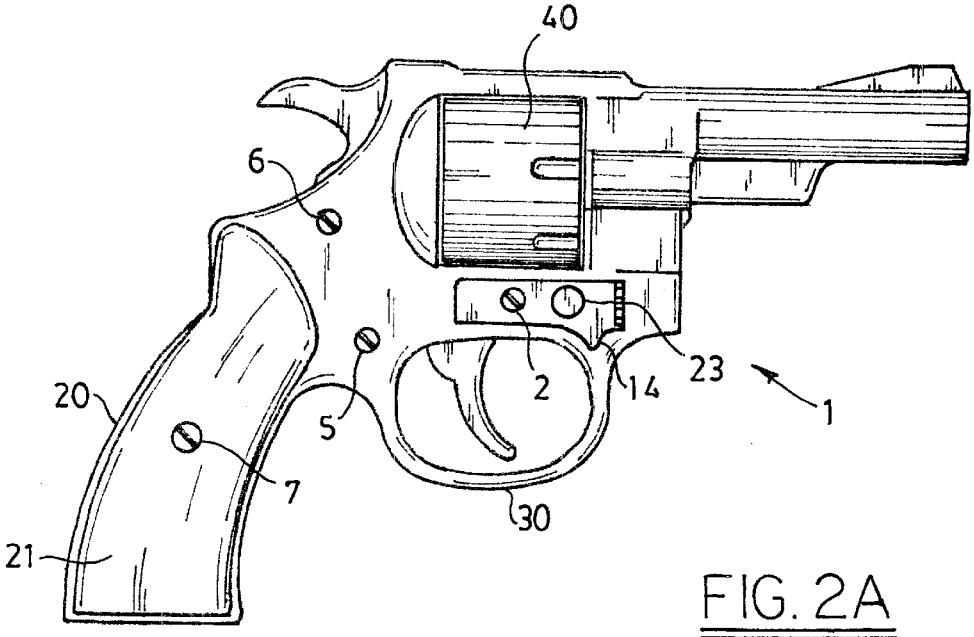
FIG. 2A provides a side view of a preferred embodiment of our invention in place on the revolver frame shown in FIG. 1, illustrating how our invention can be mounted in position via the yoke screw of the revolver.
Figure 5:
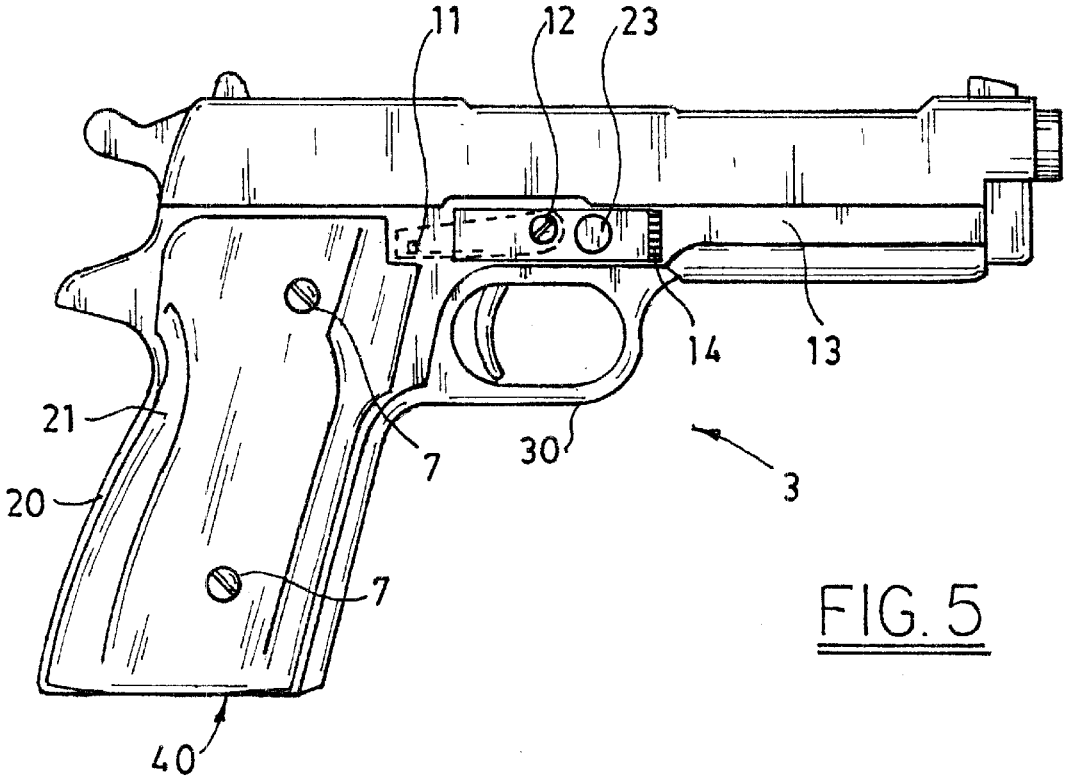
FIG. 5 provides a side view of a third embodiment of our side-mounted laser sight module in place on the right side of the automatic pistol frame illustrated in FIG. 3, illustrating how our invention can be mounted in position via a threaded takedown pin and screw on the pistol.

Yoke screw 2 and slide stop/takedown lever 11 provide the primary anchoring points for most embodiments of our invention. For example, in FIG. 2A, our laser sight module 14 is attached to the firearm frame solely by revolver yoke screw 2. Similarly, in FIG. 5, our laser sight module 14 is solely attached to the side of pistol 3 by a laser sight mounting screw 12 attached through the takedown pin 11A of automatic pistol takedown lever 11. (The axis of cylindrical takedown pin 11A must be drilled and threaded to accommodate laser mounting screw 12 in order to make this possible.)

Figure 2B:
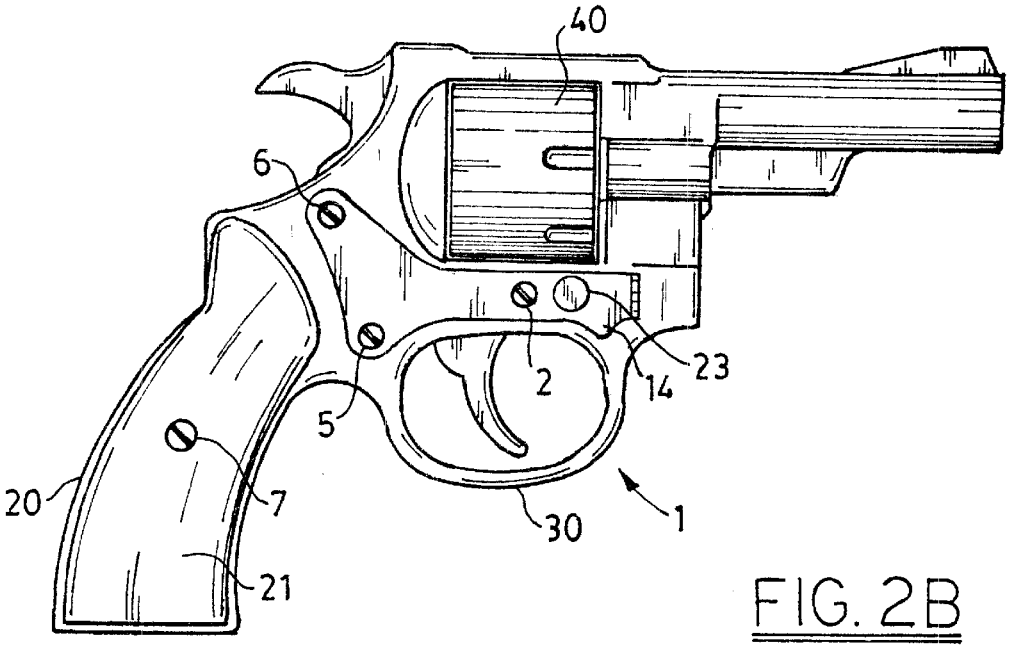
FIG. 2B provides a side view of a preferred embodiment of our invention in place on the revolver frame shown in FIG. 1, illustrating how our invention can be additionally secured in position via other side plate screws of the revolver.
Figure 3:
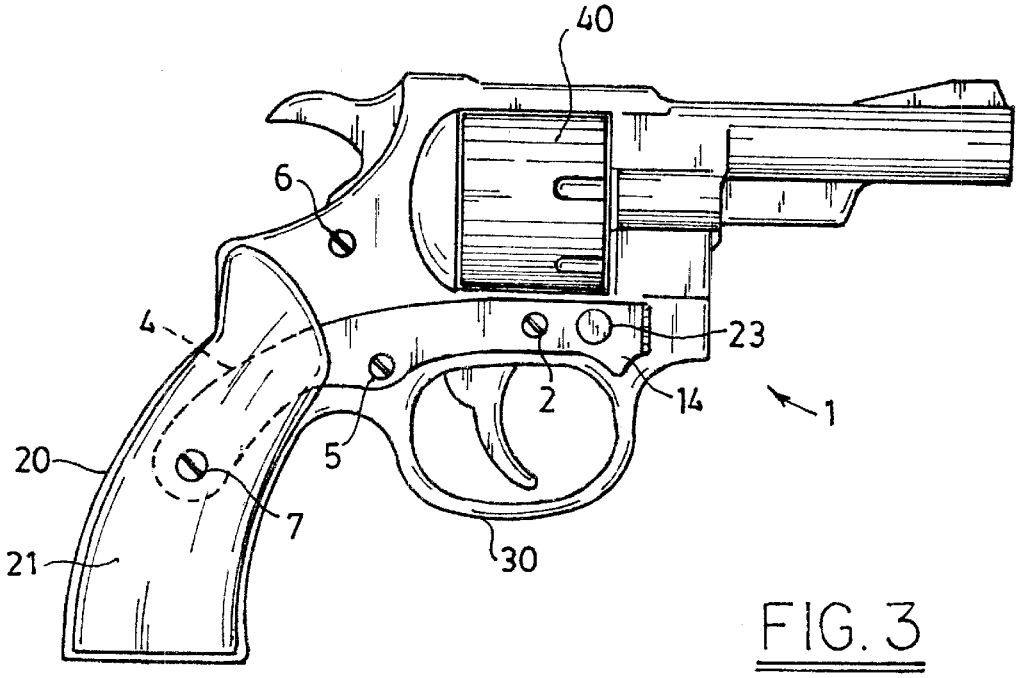
FIG. 3 provides a side view of a preferred embodiment of our side-mounted laser sight module in place on the revolver frame illustrated in FIG. 1, illustrating how our invention can be further secured in position by an extension projecting under the grip of the revolver.

Laser sight module 14 can, however, be further secured to revolver 1 and pistol 3 via other elements and screws located on the sides of pistol 3 and revolver 1. (FIG. 2B provides an example using lower screw 5 and upper screw 6 on revolver 1). Laser sight module 14 can also be secured in position (or further secured) by an extension 4 that stretches under grip panel 21, where it can, if desired, be further fastened in position by one or more grip screws 7. FIG. 3 provides an illustration of this concept as combined with some of the side-fastening methods illustrated in FIGS. 2A and 2B.

Figure 6A:
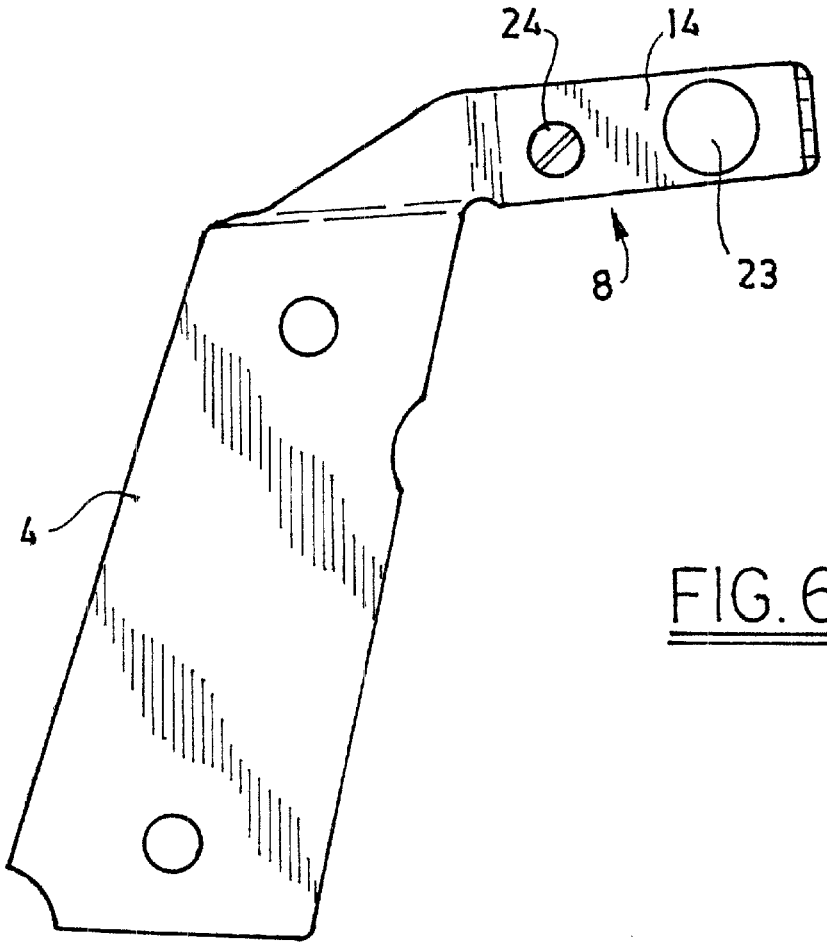
FIG. 6A provides a side view of a fourth embodiment of our side-mounted laser sight module that is secured in position solely by an extension projecting under the grip of a handgun.
Figure 6B:
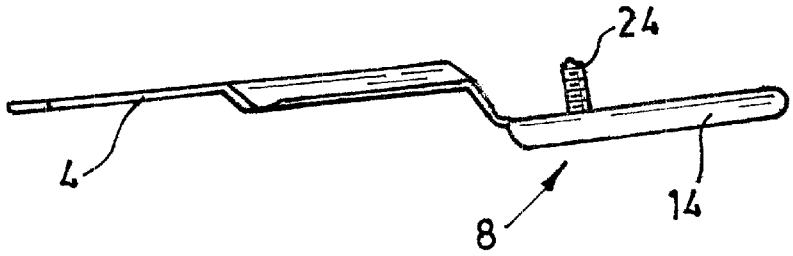
FIG. 6B provides a view from above the fourth embodiment of our invention shown in FIG. 6A.

FIGS. 6A and 6B illustrate an embodiment where grip screws and a grip serve as the sole means for holding laser sight module 14 in position on the side of a handgun. In this embodiment, extension 4 has outlines that essentially match those of an automatic pistol grip 21. Thus, its full surface area is firmly pressed and held in position against the side of a handle 20 by grip 21 when grip 21 is tightened down by grip screws 7. As illustrated in FIGS. 6A and 6B, its outer portion (denoted generally by arrow 8) can be advantageously constructed so as to stand out from the side of a handgun. Outer portion 8 should preferably be given a slight inward bias towards the side of the handgun. This allows it to act as a flexure that can be used to adjust the alignment and sighting of laser sight module 14 via adjustment screw 24.

Figure 7:
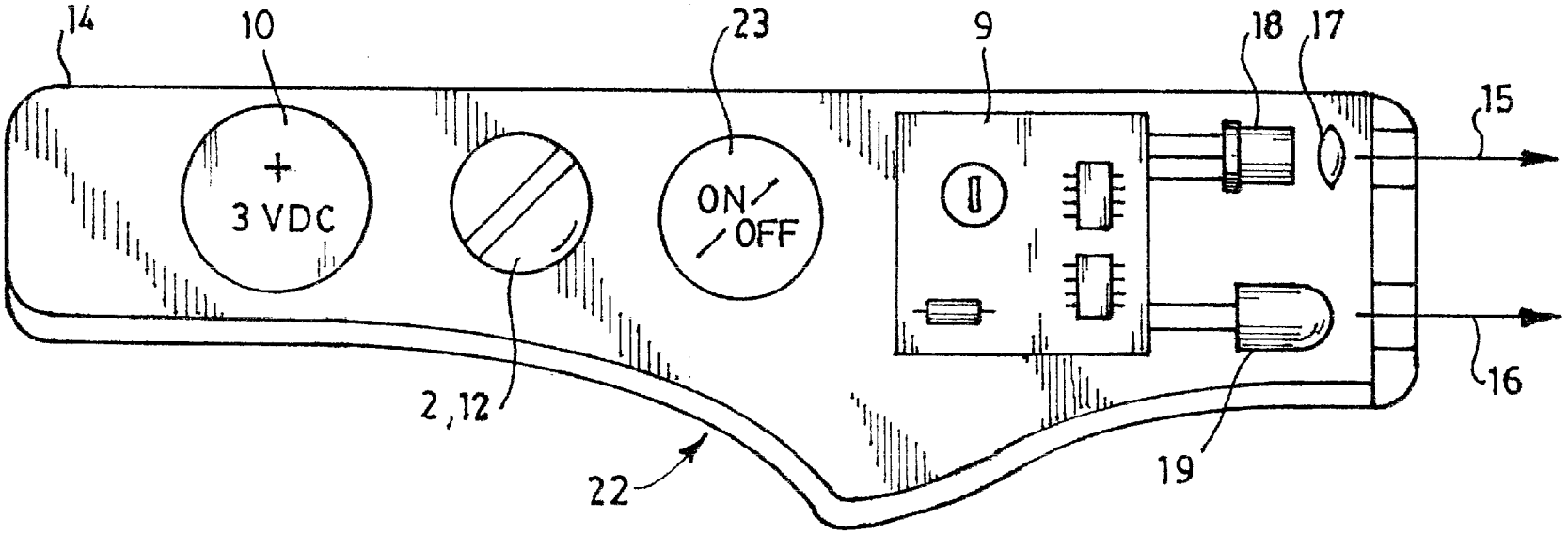
FIG. 7 provides a schematic side view of a side-mounted laser sight module produced in accordance with the teachings of our invention.

A more detailed schematic view of our invention is provided in FIG. 7 where laser sight module 14 is illustrated emitting a laser beam 15 and a light beam 16 simultaneously from its forward end for aiming and illumination, respectively. Laser sight module 14 is self-contained, including a laser-collimating lens 17, a laser diode 18, a white light LED 19, a power control circuit 9 for laser diode 18 and white light LED 19, and a battery 10. A contoured edge (denoted generally by arrow 22) can be provided so as to fit the curve located above the trigger of most handguns. (The size and shape/outline of laser module 14 can, however, be subject to numerous variations in order to fit different firearm types.) Activation switch 23 provides a simple on/off activation and deactivation of both laser diode 18 and white light LED 19 in the embodiments illustrated. However, separate activation switches could be provided if desired.

Figure 8:
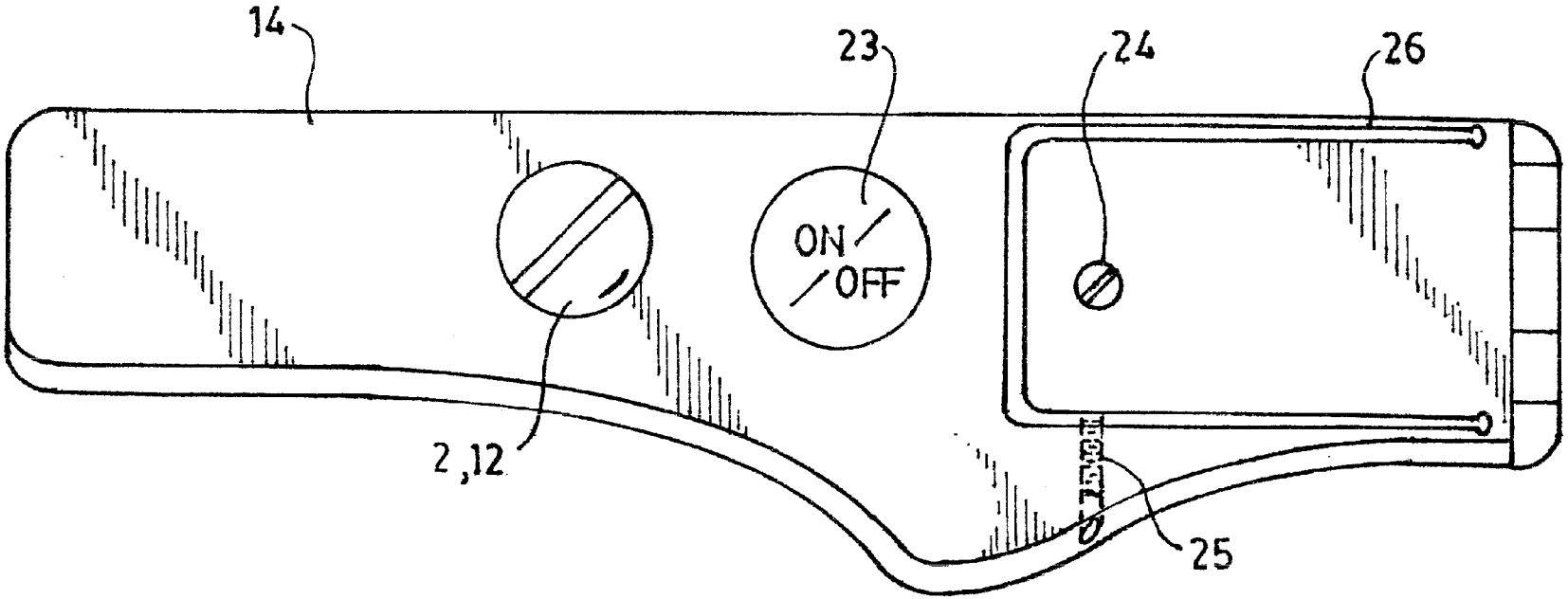
FIG. 8 provides a side view of side-mounted laser sight module produced in accordance with the teachings of our invention emphasizing one mode for aligning the laser sight.

Alignment and sighting of laser beam 15 is preferably accomplished by controlled positioning of collimating lens 17 in relation to laser diode 18. Another technique for laser alignment would involve pivoting our side-mounted laser sight module 14 around yoke screw 3 (or other side plate screw) or laser sight mounting screw 12. Finally, FIG. 8 illustrates an embodiment in which a flexure mechanism is provided to allow the controlled movement or deformation of the portion of laser-sighting module 14 bearing laser diode 18 and white light LED 19. This is accomplished with relative ease, as it is preferred to form laser-sighting module 14 from somewhat flexible polymer materials. Thus, a windage adjustment screw 24 and an elevation screw 25 will allow substantial variation and adjustment of the angles of laser beam 15 and light beam 16 emitted from the portion of laser-sighting module 14 defined by a flexure hinge cutout 26.

Many further and additional variations are possible without exceeding the ambit and scope of the inventive concept set forth herein, which relates generally to, and covers, the mounting of a laser diode and/or white light LED (preferably with activation switch) above the trigger guard, forward of the grips, and behind the front of the trigger guard of a revolver or automatic pistol using elements on the side of the firearm, including the side plate screw(s) of the revolver, the takedown lever of our automatic pistol, and/or the grips/grip screws of either.

| Parts List | |
|---|---|
| 1 | Revolver frame |
| 2 | Yoke screw |
| 3 | Automatic pistol |
| 4 | Extension |
| 5 | Lower screw |
| 6 | Upper screw |
| 7 | Grip screws |
| 8 | Outer portion |
| 9 | Power control circuit for laser diode and LED |
| 10 | Battery |
| 11 | Auto-loading pistol slide stop lever |
| 11A | Slide stop lever pin |
| 12 | Auto-loading pistol slide stop lever laser-mounting screw |
| 13 | Side of handgun |
| 14 | Side-mounted laser sight |
| 15 | Laser-sighting beam |
| 16 | White light LED illuminator beam |
| 17 | Laser-collimating lens |
| 18 | Laser diode |
| 19 | White light LED |
| 20 | Handle |
| 21 | Grip |
| 22 | Form-fitting edging for laser alignment |
| 23 | Electrical switch for finger activation of laser/LED |
| 24 | Windage adjustment screw |
| 25 | Elevation screw |
| 26 | Flexure hinge cutout |
| 30 | Trigger guard |
| 40 | Cartridge chamber |
| 50 | Side plate |

We claim:

1. A sighting system for a handgun, comprising:

a laser sight module adapted for placement against a side of the handgun above a trigger guard and forward of a handgrip of the handgun, the laser sight module having a source that can be activated to project light in a direction parallel to a barrel of the handgun and an activating switch for activating the source; and fastening means for the laser sight module engaging features on a side of the handgun.

2. A sighting system for a handgun as described in claim 1, wherein the fastening means includes an extension extending under a firearm grip panel.

3. A sighting system for a handgun as described in claim 1, wherein the source includes a laser diode projecting a laser beam when activated.

4. A sighting system for a handgun as described in claim 3, wherein the laser sight module further includes a collimating lens for the laser diode.

5. A sighting system for a handgun as described in claim 1, wherein the source includes an LED projecting a beam of light when activated.

6. A sighting system for a handgun as described in claim 1, wherein the laser sight module further includes control circuitry for the sighting system.

7. A sighting system for a handgun as described in claim 1, wherein the laser sight module further includes a battery for powering the sighting system.

8. A sighting system for a handgun as described in claim 1, wherein the laser sight module further includes an alignment mechanism for adjusting the direction of the projected light.

9. A sighting system for a handgun as described in claim 8, wherein the alignment mechanism involves adjustment of a collimating lens.

10. A sighting system for a handgun as described in claim 8, wherein the alignment mechanism involves pivoting of the laser sight module around a fastening feature.

11. A sighting system for a handgun as described in claim 8, wherein the alignment mechanism involves the use of a flexure mechanism that allows controlled movement of a portion of the laser sight module housing the source.

12. A sighting system for a handgun as described in claim 1, wherein the laser sight module, when positioned on a side of the handgun, does not interfere with holstering of the handgun.

13. A sighting system for a handgun as described in claim 1, wherein the laser sight module is contoured to fit unobtrusively against a side of the handgun.

14. A sighting system for a handgun, comprising:

a laser sight module adapted for placement against a side of the handgun above a trigger guard of the handgun, the laser sight module having a source that can be activated to project light in a direction parallel to a barrel of the handgun and an activating switch for activating the source; and fastening means for the laser sight module engaging features on a side of the handgun including a yoke screw of a revolver.

15. A sighting system for a handgun, comprising:

a laser sight module adapted for placement against a side of the handgun above a trigger guard of the handgun, the laser sight module having a source that can be activated to project light in a direction parallel to a barrel of the handgun and an activating switch for activating the source; and fastening means for the laser sight module engaging features on a side of the handgun including a screw securing a side plate of a revolver.

16. A sighting system for a handgun, comprising:

a laser sight module adapted for placement against a side of the handgun above a trigger guard of the handgun, the laser sight module having a source that can be activated to project light in a direction parallel to a barrel of the handgun and an activating switch for activating the source; and fastening means for the laser sight module engaging features on a side of the handgun including a slide stop/takedown pin of an automatic pistol.

17. A sighting system for a handgun, comprising:

a laser sight module adapted for placement against a side of the handgun above a trigger guard of the handgun, the laser sight module having a source that can be activated to project light in a direction parallel to a barrel of the handgun and an activating switch for activating the source; and fastening means for the laser sight module engaging features on a side of the handgun including a screw inserted into a slide stop/takedown pin of an automatic pistol.

18. A sighting system for a handgun, comprising:

a laser sight module adapted for placement against a side of the handgun above a trigger guard of the handgun, the laser sight module having a source that can be activated to project light in a direction parallel to a barrel of the handgun and an activating switch for activating the source, the source including a laser diode projecting a beam of laser light when activated and an incoherent light emitter projecting a beam of non-laser light when activated; and fastening means for the laser sight module engaging features on a side of the handgun.

19. A sighting system for a handgun as described in claim 18, wherein the incoherent light emitter is an LED.

20. A sighting system for a handgun, comprising:

a laser sight module adapted for placement against a side of the handgun directly above a trigger guard and forward of a handgrip of the handgun, the laser sight module having a source that can be activated to project light in a direction parallel to a barrel of the handgun, an activation switch activating the source, control circuitry for the sighting system, a battery for powering the sighting system, and an alignment mechanism for adjusting the direction of the projected light; and fastening means for the laser sight module engaging features on a side of the handgun.

21. A sighting system for a handgun as described in claim 20, wherein the fastening means includes an extension extending under a firearm grip panel.

22. A sighting system for a handgun as described in claim 20, wherein the source includes a laser diode projecting a laser beam when activated.

23. A sighting system for a handgun as described in claim 22, wherein the laser sight module further includes a collimating lens for the laser diode.

24. A sighting system for a handgun as described in claim 20, wherein the source includes an LED projecting a beam of light when activated.

25. A sighting system for a handgun as described in claim 20, wherein the alignment mechanism involves adjustment of a collimating lens.

26. A sighting system for a handgun as described in claim 20, wherein the alignment mechanism involves pivoting of the laser sight module around a fastening feature.

27. A sighting system for a handgun as described in claim 20, wherein the alignment mechanism involves the use of a flexure mechanism that allows controlled movement of a portion of the laser sight module housing the source.

28. A sighting system for a handgun as described in claim 20, wherein the laser sight module, when positioned on a side of the handgun, does not interfere with holstering of the handgun.

29. A sighting system for a handgun as described in claim 20, wherein the laser sight module is contoured to fit unobtrusively against a side of the handgun.

30. A sighting system for a handgun, comprising:

a laser sight module adapted for placement against a side of the handgun above a trigger guard of the handgun, the laser sight module having a source that can be activated to project light in a direction parallel to a barrel of the handgun, an activation switch activating the source, control circuitry for the sighting system, a battery for powering the sighting system, and an alignment mechanism for adjusting the direction of the projected light; and fastening means for the laser sight module engaging features on a side of the handgun including a yoke screw of a revolver.

31. A sighting system for a handgun, comprising:

a laser sight module adapted for placement against a side of the handgun above a trigger guard of the handgun, the laser sight module having a source that can be activated to project light in a direction parallel to a barrel of the handgun, an activation switch activating the source, control circuitry for the sighting system, a battery for powering the sighting system, and an alignment mechanism for adjusting the direction of the projected light; and fastening means for the laser sight module engaging features on a side of the handgun including a screw securing a side plate of a revolver.

32. A sighting system for a handgun, comprising:

a laser sight module adapted for placement against a side of the handgun above a trigger guard of the handgun, the laser sight module having a source that can be activated to project light in a direction parallel to a barrel of the handgun, an activation switch activating the source, control circuitry for the sighting system, a battery for powering the sighting system, and an alignment mechanism for adjusting the direction of the projected light; and fastening means for the laser sight module engaging features on a side of the handgun including a slide stop/takedown pin of an automatic pistol.

33. A sighting system for a handgun, comprising:

a laser sight module adapted for placement against a side of the handgun above a trigger guard of the handgun, the laser sight module having a source that can be activated to project light in a direction parallel to a barrel of the handgun, an activation switch activating the source, control circuitry for the sighting system, a battery for powering the sighting system, and an alignment mechanism for adjusting the direction of the projected light; and fastening means for the laser sight module engaging features on a side of the handgun including a screw inserted into a slide stop/takedown pin of an automatic pistol.

34. A sighting system for a handgun, comprising:

a laser sight module adapted for placement against a side of the handgun above a trigger guard of the handgun, the laser sight module having a source that can be activated to project light in a direction parallel to a barrel of the handgun, an activation switch activating the source, control circuitry for the sighting system, a battery for powering the sighting system, and an alignment mechanism for adjusting the direction of the projected light, the source including a laser diode projecting a laser beam when activated and an incoherent light emitter projecting a beam of non-laser light when activated; and fastening means for the laser sight module engaging features on a side of the handgun.

35. A sighting system for a handgun as described in claim 34, wherein the incoherent light emitter is an LED.

36. A sighting system for a handgun, comprising:

a laser sight module adapted for placement against a side of the handgun above a trigger guard and forward of a handgrip of the handgun, the laser sight module having a source that can be activated to project light in a direction parallel to a barrel of the handgun; and fastening means for the laser sight module engaging features on a side of the handgun.

37. A sighting system for a handgun as described in claim 36, the laser sight module having an activating switch for activating the source.

38. A sighting system for a handgun as described in claim 36, wherein the fastening means includes an extension extending under a firearm grip panel.

39. A sighting system for a handgun as described in claim 36, wherein the source includes a laser diode projecting a laser beam when activated.

40. A sighting system for a handgun as described in claim 39, wherein the laser sight module further includes a collimating lens for the laser diode.

41. A sighting system for a handgun as described in claim 36, wherein the source includes an LED projecting a beam of light when activated.

42. A sighting system for a handgun as described in claim 36, wherein the laser sight module further includes control circuitry for the sighting system.

43. A sighting system for a handgun as described in claim 36, wherein the laser sight module further includes a battery for powering the sighting system.

44. A sighting system for a handgun as described in claim 36, wherein the laser sight module further includes an alignment mechanism for adjusting the direction of the projected light.

45. A sighting system for a handgun as described in claim 44, wherein the alignment mechanism involves pivoting of the laser sight module around a fastening feature.

46. A sighting system for a handgun as described in claim 44, wherein the alignment mechanism involves the use of a flexure mechanism that allows controlled movement of a portion of the laser sight module housing the source.

47. A sighting system for a handgun as described in claim 44, wherein the alignment mechanism involves adjustment of a collimating lens.

48. A sighting system for a handgun as described in claim 36, wherein the laser sight module, when positioned on a side of the handgun, does not interfere with holstering of the handgun.

49. A sighting system for a handgun as described in claim 36, wherein the laser sight module is contoured to fit unobtrusively against a side of the handgun.

50. A sighting system for a handgun, comprising:

a laser sight module adapted for placement against a side of the handgun above a trigger guard of the handgun, the laser sight module having a source that can be activated to project light in a direction parallel to a barrel of the handgun; and fastening means for the laser sight module engaging features on a side of the handgun including a yoke screw of a revolver.

51. A sighting system for a handgun, comprising:

a laser sight module adapted for placement against a side of the handgun above a trigger guard of the handgun, the laser sight module having a source that can be activated to project light in a direction parallel to a barrel of the handgun; and fastening means for the laser sight module engaging features on a side of the handgun including a screw securing a side plate of a revolver.

52. A sighting system for a handgun, comprising:

a laser sight module adapted for placement against a side of the handgun above a trigger guard of the handgun, the laser sight module having a source that can be activated to project light in a direction parallel to a barrel of the handgun; and fastening means for the laser sight module engaging features on a side of the handgun including slide stop/takedown pin of an automatic pistol.

53. A sighting system for a handgun, comprising:

a laser sight module adapted for placement against a side of the handgun above a trigger guard of the handgun, the laser sight module having a source that can be activated to project light in a direction parallel to a barrel of the handgun; and fastening means for the laser sight module engaging features on a side of the handgun including a screw inserted into a slide stop/takedown pin of an automatic pistol.

54. A sighting system for a handgun, comprising:

a laser sight module adapted for placement against a side of the handgun above a trigger guard of the handgun, the laser sight module having a source that can be activated to project light in a direction parallel to a barrel of the handgun, the source including a laser diode projecting a beam of laser light when activated and an incoherent light emitter projecting a beam of non-laser light when activated; and fastening means for the laser sight module engaging features on a side of the handgun.

55. A sighting system for a handgun as described in claim 54, wherein the incoherent light emitter is an LED.

* * * * *